United States Patent [19]

Bagolin et al.

[11] Patent Number: 4,694,588

[45] Date of Patent: Sep. 22, 1987

[54] DRY CLEANING MACHINE

[75] Inventors: Alain Bagolin, Dijon; Joël Gay, Saulon La Chapelle, both of France

[73] Assignee: Frimair S.A., Longvic, France

[21] Appl. No.: 869,015

[22] Filed: May 28, 1986

[30] Foreign Application Priority Data

Jun. 5, 1985 [FR] France ..... 85 08458

[51] Int. Cl.[4] ..... F26B 21/10

[52] U.S. Cl. ..... 34/77; 62/181; 62/183; 62/185

[58] Field of Search ..... 62/181, 183, 185, 506; 34/77

[56] References Cited

U.S. PATENT DOCUMENTS

| | | | |
|---|---|---|---|
| 3,091,100 | 5/1963 | Sorensen et al. | 62/506 |
| 3,498,072 | 3/1970 | Stiefel | 62/506 |
| 3,676,937 | 7/1972 | Janson . | |
| 3,831,294 | 8/1974 | Freze . | |
| 4,499,743 | 2/1985 | Maestrelli . | |

FOREIGN PATENT DOCUMENTS

| | | |
|---|---|---|
| 0053727 | 6/1982 | European Pat. Off. . |
| 0100082 | 2/1984 | European Pat. Off. . |
| 3327797 | 6/1984 | Fed. Rep. of Germany . |
| 1068317 | 5/1967 | United Kingdom . |
| 2060713 | 5/1981 | United Kingdom . |

*Primary Examiner*—Larry I. Schwartz

*Attorney, Agent, or Firm*—Young & Thompson

[57] ABSTRACT

The dry cleaning machine according to the invention comprises: a rotating drum (1) disposed in an enclosed chamber (2); an air flow duct (3) in the form of a closed loop in association with the chamber (2); and a cooling circuit having a condenser (6) disposed in the air flow duct (3) downstream of an evaporator (10) and is characterized by a control circuit (11) comprising: an internal heat exchanger (12) interlaced at least to some extent with the condenser (6); and means (13) for controlling the flow of a fluid in the control circuit (11).

10 Claims, 6 Drawing Figures

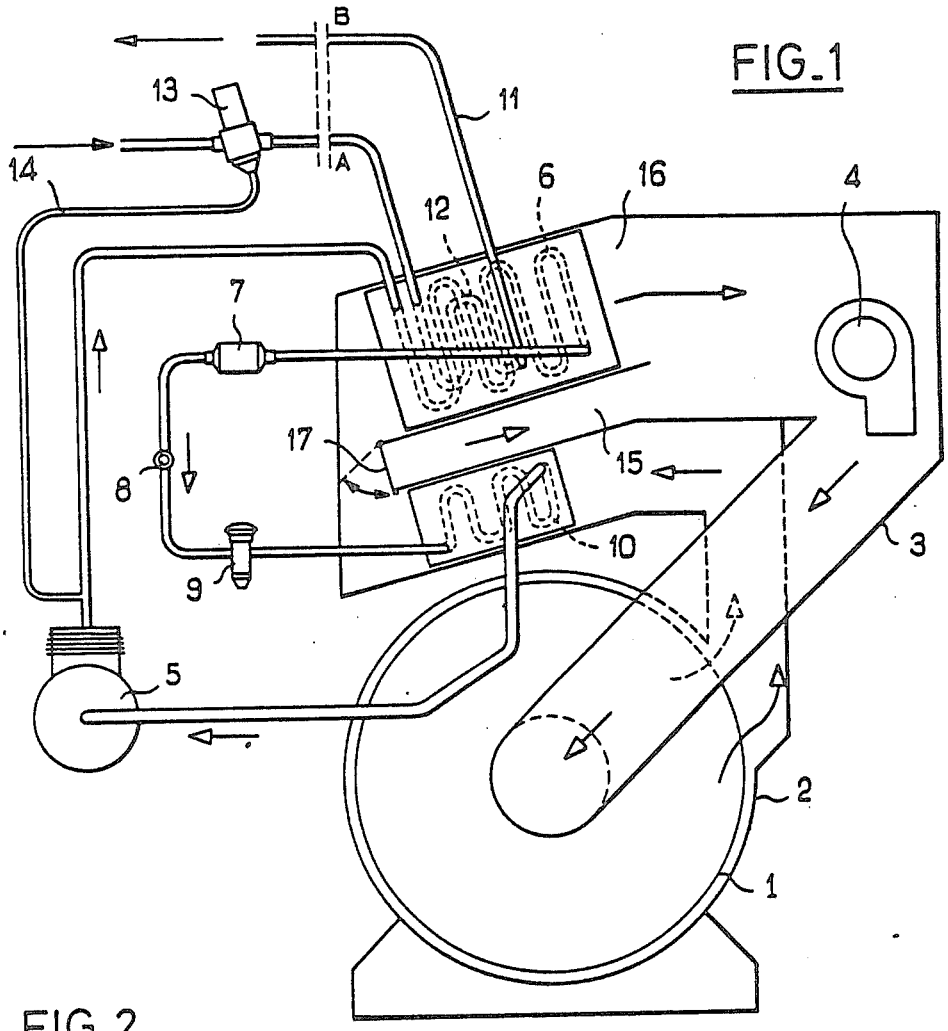
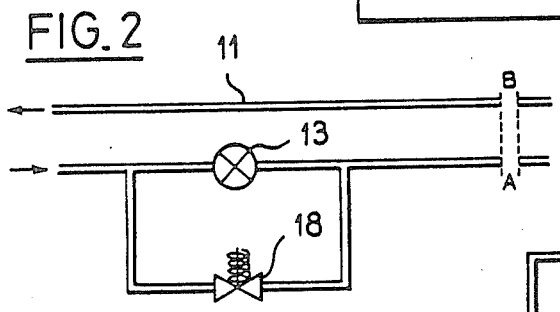
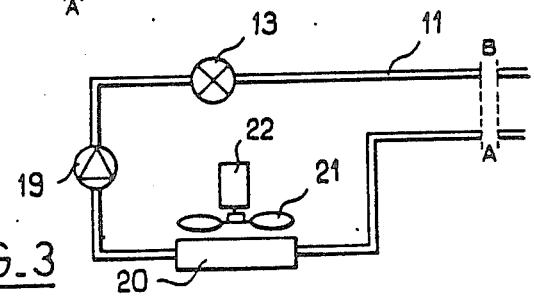
FIG_3

DRY CLEANING MACHINE

This invention relates to a dry cleaning machine.

A dry cleaning machine usually of course comprises a drum for receiving the articles for cleaning. A motor rotates the drum reciprocatingly so that the articles experience rubbing movements and drop into a liquid cleaning bath which is usually perchloroethylene or some other fluorinated solvent.

After the cleaning cycle the drum rotates at high speed for centrifuging, whereafter drying proceeds by air flowing through an air flow duct which is in a closed-loop relationship with the enclosed chamber where the drum is disposed. The air flow passes seriatim in the drum over the articles, over the evaporator of a cooling circuit and over the condenser thereof and possibly over an additional heating facility. Consequently, the hot air entering the drum evaporates the solvent present in the articles, the solvent vehicled along by the air flow condenses on the evaporator of the cooling circuit and is removed from the evaporator to a tank, and the air is reheated on the condenser and, where applicable, by the additional heating facility before returning to the drum.

The drying cycle usually lasts for some 15 to 30 minutes and the various heating steps tend to overheat the machine; consequently, cooling must be provided otherwise the pressure in the cooling circuit becomes excessive and impairs the operation thereof. Cooling in the known machines is provided by an auxiliary air-cooled or water-cooled condenser disposed outside the air flow duct of the machine. The auxiliary condenser and the various elements associated with it make the cooling circuit fairly complex and considerably increase the risk of malfunctioning of the cooling circuit.

It is an object of this invention to simplify the existing machines and to reduce the risk of malfunctioning, more particularly the risk of a malfunction of the associated cooling circuit.

Accordingly, the invention provides a dry cleaning machine comprising: a rotating drum disposed in an enclosed chamber; an air flow duct in closed-loop relationship with the chamber; means for impelling air through the air flow duct; and a cooling circuit having an evaporated disposed in the air flow duct and a condenser disposed therein downstream of the evaporator as considered in the direction of air flow in the air flow duct, characterised in that it comprises a temperature control circuit having an internal heat exchanger interlaced at least to some extent with the condenser in the air flow duct; and means adapted to control the flow of a fluid in the control circuit and to operate in dependence upon the pressure in the cooling circuit.

The cooling circuit is therefore of very simple construction and the pressure in the cooling circuit is controlled by action on the means controlling fluid flow in the control circuit.

In a more particular first embodiment of the invention, the control circuit is connected to a cold fluid supply network and the means for controlling the flow of fluid comprise a manometrically actuated control valve which is disposed in the temperature control circuit and whose manometric control element is connected to the cooling circuit. The supply network therefore supplies the internal heat exchanger with cold fluid with a delivery controlled by the control valve in dependence upon cooling circuit pressure.

In an advantageous form of the latter embodiment, the control circuit comprises a bypass solenoid valve in parallel with the control valve. The opening of the bypass solenoid valve therefore produces a substantial drop in cooling circuit pressure and, therefore, a temperature drop, with the result of a substantial decrease in the temperature of the air in the air flow duct. This temperature decrease is useful more particularly in the deodorization phase when the air temperature in the air flow duct must be relatively low in order to condense the final solvent vapours.

In another advantageous form of the invention, the air flow duct comprises: a bypass duct part parallel to an air flow duct part where the condenser is disposed; and a flap movable between a first position, in which it closes the bypass duct part and opens the duct part where the condenser is disposed, and a second position, in which it closes the last-mentioned duct part and opens the bypass duct part. Consequently, in the drying phase air passes over the condenser and is reheated thereby, while in the deodorization phase air flows through the bypass duct part and thus remains substantially at the temperature it had after passing over the evaporator.

According to another embodiment of the invention, the control circuit comprises a closed loop comprising fluid-impelling means and an external heat exchanger disposed outside the air flow duct; the fluid flow control means comprise a control valve which is disposed in the control circuit and has its manometric control element connected to the cooling circuit; and the air flow duct comprises a bypass duct part parallel to an air flow duct part receiving the condenser and a flap movable between a first position, in which it closes the bypass duct part and opens the condenser-receiving duct part, and a second position, in which it closes the last-mentioned duct part and opens the bypass duct part. Consequently, the closed loop is responsible for pressure control in the cooling circuit and the bypass duct part controls the temperature in the air flow duct.

In an advantageous form of the embodiment in which the duct has a bypass part, the control circuit has an accumulator for the control fluid.

Consequently, in the deodorization phase the control fluid heats up in contact with the condenser and, at the start of the next drying phase, restores the heat thus accumulated.

Advantageously, the closed loop control circuit comprises: a fluid accumulator in series with the heat exchangers; means for reversing the direction of fluid flow in the accumulator; and unidirectional flow means disposed in parallel with the control valve and passing a flow of fluid in the sense of a direct connection from the accumulator to the internal heat exchanger. Consequently, in the initial part of the drying phase hot fluid is sampled in the accumulator and provides rapid heating of the air in the air flow circuit, and when the temperature becomes excessive the flow direction reverses and low-temperature fluid goes into the internal heat exchanger of the control circuit, the delivery of the low-temperature fluid being controlled by the control valve.

Other features and advantages of the invention will become apparent from the following description of non-limitative examples, reference being made to the accompanying drawings wherein:

FIG. 1 is a diagrammatic representation of a first embodiment of the invention;

FIG. 2 is a partial diagrammatic representation of a first variant of the control circuit;

FIG. 3 is a partial diagrammatic representation of a second variant of the control circuit;

Figure 4:
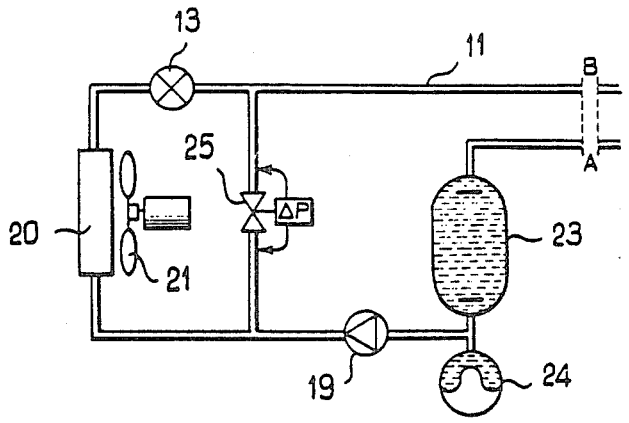
FIG. 4 is a partial diagrammatic representation of a third variant of the control circuit.

Referring to FIG. 1, the dry cleaning machine according to the invention has in conventional manner a rotating drum 1 disposed in an enclosed chamber 2 and an air flow duct 3 in the form of a closed loop in association with the chamber 2, one end of the duct 3 extending to the periphery of the drum 1 while its other end extends to the centre of the drum 1. A fan 4 in the duct 3 impels the air therethrough.

The machine also comprises a cooling circuit comprising seriatim in the direction of cooling fluid flow a compressor 5, a condenser 6, a dehydrator 7, a liquid telltale 8, an expansion element 9 and an evaporator 10.

According to the invention, the machine also comprises: a control circuit 11 having an internal heat exchanger 12 interlaced at least to some extent with the condenser 6 in the duct 3; and means for controlling the flow of a fluid in the control circuit 11. In the embodiment shown in FIG. 1 the control means comprise a manometrically controlled control valve 13 whose manometric tube 14 is connected to the cooling circuit at the output of the compressor 5.

The cooling circuit 11 is also connected to a cold fluid source (not shown) such as a cold-water network or a cooling tower.

In the first embodiment the machine also comprises in the duct 3: a bypass part 15 in parallel with a part 16 of the duct 3, the part 16 receiving the condenser 6; and a flap 17 movable between a first position, which is shown in solid line in FIG. 1 and in which the flap 17 closes the bypass duct 15 and opens the condenser-receiving duct part 16, and a second position which is shown in chain lines in FIG. 1 and in which it closes the consenser-receiving duct part 16 and opens the bypass duct part 15.

This embodiment operates as follows:

In the drying phase the flap 17 closes the bypass part 15 and the air containing solvent vapour and issuing from the drum 1 first flows past the evaporator 10, the solvent vapours condensing and returning to a tank (not shown). The vapour-free air then goes to the condenser 6 and is heated thereby before returning to the drum 1 to receive further solvent. When the condenser termperature becomes excessive, pressure rises in the manometric tube 14 and the valve 13 opens, so that the cold fluid flows through the control circuit 11 and the condenser 6 therefore cools, with the result that the pressure in the cooling circuit returns to a normal value.

The internal heat exchanger 12 is preferably interlaced with the condenser 6 only in a part which is upstream of the condenser as considered in the direction of air flow; consequently, even when cold fluid flows through the control circuit 11 some of the condenser remains at a high temperature and heats the air flowing through the duct 3 just before the return of such air to the drum 1. Controlling the pressure of the cooling circuit therefore does not impair satisfactory operation of the machine.

In the deodorization phase the flap 17 pivots to close the condenser-receiving duct part 16 and the cool air which has just passed over the evaporator 10 returns directly to the drum 1 in which it condenses the vapours in suspension.

FIG. 2 illustrates a variant of the control circuit, of use more particularly in the absence of a bypass part 15 in the air flow duct 3. To simplify the diagram FIG. 2 shows only that part of the circuit which is disposed beyond the connection points A and B of FIG. 1. In this variant the control circuit 11 is connected as previously to a cold fluid source and also comprises a control valve 13. However, in the present case the control circuit further comprises a bypass valve 18 which preferably has a substantial delivery. The valve 18 remains closed in the drying phase and so operation is exactly as in the previous embodiment.

In the deodorization phase the valve 18 is open and there is a substantial flow of cold fluid through it to the heat exchanger 12. Consequently, the condenser 6 is cooled more intensely than in the drying phase and the air flowing through the air flow duct is cooled sufficiently to enable it to condense the suspended vapours. As an example, the rates of flow through the valves 13 and 18 respectively are such that the condenser is at a temperature of the order of 70° C. in the drying phase and of the order of from 35° to 40° C. in the deodorization phase.

FIG. 3 illustrates a second variant of the control circuit 11 wherein the same is not connected to a cold fluid source but is in the form of a closed loop comprising the control valve 13, fluid-impelling means in the form of a pump 19 and an external heat exchanger 20 disposed outside the air flow duct 3. To accelerate heat exchange with the external heat exchanger 20, it is preferable to provide a fan 21 driven by a motor 22. Operation is very similar to what has been described with reference to FIG. 1. In the drying phase the air flowing through the duct 3 flows over the condenser 6; whenever the temperature thereof becomes excessive the valve 13 opens so that fluid flows through the control circuit 11. The hot fluid sampled at the outlet of the internal heat exchanger 12 is cooled in the external heat exchanger 20, then returns to the internal heat exchanger 12 to control the temperature of the condenser 6 and, therefore, the pressure in the cooling circuit. In the deodorization phase the flap 17 is operated to open the bypass duct part 15, as described in connection with the embodiment of FIG. 1.

FIG. 4 illustrates a third embodiment of the control circuit 11 wherein the same comprises a valve 13 identical to the one hereinbefore described, an external heat exchanger 20, the associated fan 21 and a circulating pump 19. The circuit also comprises a fluid accumulator in series with the internal heat exchanger 13, the accumulator taking the form of a receptacle or vessel 23 in a conventional association with an expansion vessel 24, means being provided which respond to closure of the valve 13 by forming a loop including the heat exchanger and the fluid accumulator. The loop-forming means preferably comprise a differential pressure valve 25 disposed between an inlet line of the heat exchanger and an outlet line of the accumulator. This embodiment operates as follows:

When the control valve 13 is closed, the differential pressure detector opens the valve 25 and the control fluid flows through the circuit 11 by way of the valve 25 and is heated by contact with the condenser 6. When the pressure in the cooling circuit rises and the control valve 13 opens, the pressure difference across the valve 25 cannot keep the same open and all the fluid passes through the external heat exchanger 20 and is cooled thereby before returning to the internal heat exchanger 12. The circuit therefore provides its control function. In the deodorization phase the air goes through the bypass duct part 15 and the condenser 6 heats up. Control fluid at the control temperature therefore builds up in the reservoir 23 and restores the heat thus accumulated at the start of the next drying cycle, thus providing a quicker heat-up of the drying air flowing through the duct 3.

Figure 5:
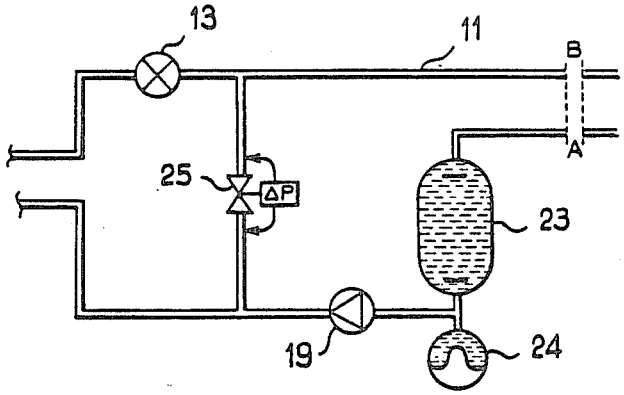
FIG. 5 is a diagrammatic representation of a fourth variant of the control circuit.

FIG. 5 illustrates an embodiment which is very similar to the embodiment of FIG. 4, the only difference being that in FIG. 5 the circuit 11 is connected to a cold fluid source when the control valve 13 is open. In other respects the construction and operation of the circuit are identical to what has been described with reference to FIG. 4.

Figure 6:
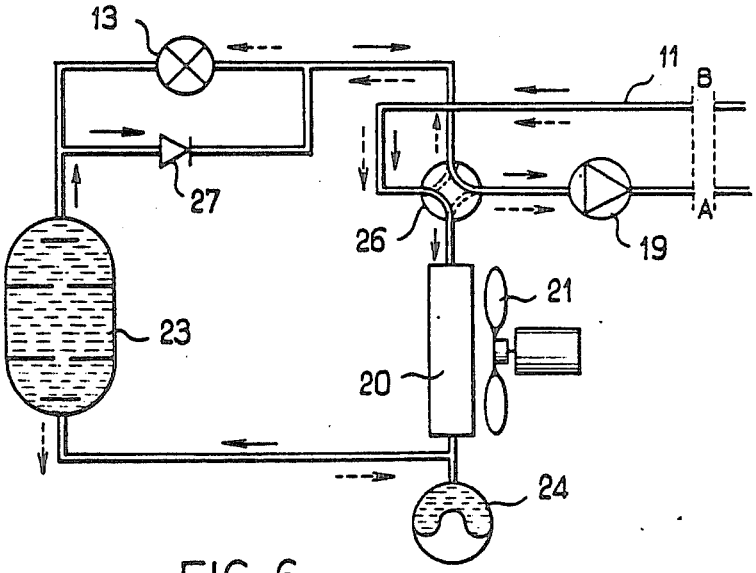
FIG. 6 is a partial diagrammatic representation of a fifth variant of the control circuit.

FIG. 6 illustrates a fifth embodiment in which the control circuit 11 has as in the previous embodiments a control valve 13, a circulating pump 19, an external heat exchanger 20, the associated fan 21, a reservoir 23 and the associated expansion vessel 24. The control circuit also has means for reversing the direction of fluid flow in the accumulator or reservoir, such means taking the form of a four-way valve 26, the control circuit also comprising unidirectional flow means arranged in parallel with the control valve and taking the form of a check valve 27. This variant operates as follows:

At the start of the drying phase the four-way valve 26 is placed in the solid-line position in FIG. 6. Fluid therefore flows in the direction indicated by solid-line arrows. More particularly, hot fluid is sampled at the top part of the reservoir 23 and flows freely through the check valve 27 towards the internal heat exchanger 12. The heat thus supplied to the duct 3 produces a rapid rise in the temperature of the air flowing through the duct 3. When the air therein has reached its normal drying temperature, the valve 26 moves into the chain-line position in FIG. 6. The control fluid then flows in the direction indicated by chain-line arrows. More particularly, the control fluid cannot flow through the check valve 27, the same permitting a flow only in the sense of a direct communication from the reservoir 23 to the internal heat exchanger 12. When the control valve 13 opens, the coldest fluid is sampled at the bottom part of the reservoir 23, further cooled in the external heat exchanger 20 and flows to the internal heat exchanger 12 where it cools the condenser.

The invention is not of course limited to the embodiments hereinbefore described, which may be varied.

More particularly, the embodiment shown in FIG. 3 can comprise a bypass solenoid valve similar to the bypass solenoid valve of FIG. 2 and a two-speed motor 22, the fast speed being used in the deodorization phase to provide more intensive cooling than in the drying phase.

The movements of the flap or valve 17 can be controlled either by the cycle of the machine or by temperature detectors disposed in the air flow duct.

We claim:

1. A dry cleaning machine comprising: a rotating drum (1) disposed in an enclosed chamber (2); an air flow duct (3) in a closed-loop relationship with the chamber (2); means (4) for impelling air through the air flow duct (3) toward the chamber (2) and a cooling circuit having an evaporator (10) disposed in the air flow duct (3) and a single condenser (6) disposed therein downstream of the evaporator (10) as considered in the direction of air flow in the air flow duct (3), wherein a temperature control circuit (11) having an internal heat exchanger (12) is interlaced at least to some extent with the condenser (6) in the air flow duct (3); and means (13) to control the flow of a fluid in the control circuit (11) and to operate in dependence upon the pressure in the cooling circuit.

2. A machine according to claim 1, wherein the control circuit (11) is connected to a cold fluid supply network and said means to control the flow of the fluid comprise a manometrically actuated control valve (13) which is disposed in the temperature control circuit (11) and whose manometric control element is connected to the cooling circuit.

3. A machine according to claim 2, wherein the control circuit (11) comprises a bypass solenoid valve (18) in parallel with the control valve (13).

4. A machine according to claim 2, comprising a bypass duct part (15) parallel to an air flow duct part (16) wherein the condenser (6) is disposed; and a flap (17) movable between a first position, in which it closes the bypass duct part (15) and opens the duct part (16) wherein the condenser is disposed, and a second position, in which it closes the last-mentioned duct part (16) and opens the bypass duct part (15).

5. A machine according to claim 1, wherein the control circuit (11) comprises a closed loop comprising fluid-impelling means (18) and an external heat exchanger (20) disposed outside the air flow duct (3); the fluid flow control means comprise a control valve (13) which is disposed in the control circuit (11) and has a manometric control element connected to the cooling circuit; and the air flow duct (3) comprises a bypass duct part (15) parallel to an air flow duct part (16) wherein is disposed the condenser (6) and a flap (17) movable between a first position, in which it closes the bypass duct part (15) and opens the condenser-receiving duct part (16), and a second position, in which it closes the last-mentioned duct part (16) and opens the bypass duct part (15).

6. A machine according to claim 4, wherein the control circuit comprises a fluid accumulator (23) in series with the internal heat exchanger (12); and means (25) which respond to closure of the control valve (13) by forming a fluid flow a loop comprising the internal heat exchanger (12) and the fluid accumulator (23).

7. A machine according to claim 6, wherein the loop-forming means comprise a differential pressure valve (25) disposed between an inlet line of the internal heat exchanger (12) and an outlet line of the fluid accumulator (23).

8. A machine according to claim 5, comprising a fluid accumulator (23) in series with the heat exchangers; means (26) for reversing the direction of fluid flow in the accumulator (23); and unidirectional flow means (27) disposed in parallel with the control valve (13) and passing a flow of fluid in the sense of a direct connection from the accumulator (23) to the heat exchanger (12).

9. A machine according to claim 8, wherein the means for reversing fluid flow in the accumulator (23) comprise a four-way valve (26).

10. A machine according to claim 1, wherein the internal heat exchanger (12) is interlaced with the condenser (6) only in an upstream part of the condenser (6) as considered in the air flow direction.

* * * * *